US008726646B2

(12) United States Patent
Riedel et al.

(10) Patent No.: US 8,726,646 B2
(45) Date of Patent: May 20, 2014

(54) HYDRAULIC SYSTEM HAVING MULTIPLE ACTUATORS AND AN ASSOCIATED CONTROL METHOD

(75) Inventors: Ray Riedel, Elyria, OH (US); Amir Shenouda, Avon Lake, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 881 days.

(21) Appl. No.: 12/866,941

(22) PCT Filed: Mar. 6, 2009

(86) PCT No.: PCT/US2009/036294

§ 371 (c)(1), (2), (4) Date: Aug. 10, 2010

(87) PCT Pub. No.: WO2009/114407

PCT Pub. Date: Sep. 17, 2009

(65) Prior Publication Data

US 2011/0000203 A1 Jan. 6, 2011

Related U.S. Application Data

(60) Provisional application No. 61/035,183, filed on Mar. 10, 2008.

(51) Int. Cl.
*F15B 13/04* (2006.01)

(52) U.S. Cl.
USPC ..... 60/422; 60/452

(58) Field of Classification Search
USPC ..... 60/422, 452, 484
See application file for complete search history.

(56) References Cited

U.S. PATENT DOCUMENTS

| | | | |
|---|---|---|---|
| 3,744,243 | A | 7/1973 | Faisandier |
| 3,827,453 | A | 8/1974 | Malott et al. |
| 3,935,707 | A | 2/1976 | Murphy et al. |

(Continued)

FOREIGN PATENT DOCUMENTS

| | | |
|---|---|---|
| DE | 631208 | 5/1942 |
| EP | 1403529 A2 | 3/2004 |

(Continued)

OTHER PUBLICATIONS

Milan Djurovic and Siegried Helduser, "Electrohydraulisches Load-Sensing", XP-001212514, Oct. 2004.*

(Continued)

*Primary Examiner* — Thomas E Lazo
(74) *Attorney, Agent, or Firm* — Renner, Otto, Boisselle & Sklar, LLP

(57) ABSTRACT

A hydraulic system, and associated method of control, includes an operator input device, a source of hydraulic fluid flow, and a plurality of actuators. At least one valve associated with each actuator for controlling a flow of fluid to and from the actuator. A controller is responsive to a signal from the operator input device to calculate a hydraulic pressure to be supplied to each of the actuators. The controller controls the source of hydraulic fluid flow and the valves for powering the actuators with the calculated hydraulic pressure. The controller also monitors a sensed parameter to determine whether the actuators can be powered with the calculated hydraulic pressure, and in response to a determination that the actuators cannot be powered with the calculated hydraulic pressure, calculates a discrepancy ratio and modifies actuation of the actuators with the discrepancy ratio.

16 Claims, 6 Drawing Sheets

(56) References Cited

U.S. PATENT DOCUMENTS

| | | | | |
|---|---|---|---|---|
| 4,726,186 | A | 2/1988 | Tatsumi et al. | |
| 5,297,381 | A | 3/1994 | Eich et al. | |
| 5,394,696 | A * | 3/1995 | Eich et al. | 60/420 |
| 5,481,875 | A | 1/1996 | Takamura et al. | |
| 6,209,321 | B1 | 4/2001 | Ikari | |
| 6,216,456 | B1 | 4/2001 | Mitchell | |
| 6,389,808 | B1 | 5/2002 | Sakai | |
| 6,684,636 | B2 | 2/2004 | Smith | |
| 6,718,759 | B1 * | 4/2004 | Tabor | 91/459 |
| 6,732,512 | B2 | 5/2004 | Pfaff et al. | |
| 6,745,992 | B2 | 6/2004 | Yang et al. | |
| 6,779,340 | B2 * | 8/2004 | Pfaff et al. | 60/422 |
| 6,837,046 | B2 | 1/2005 | Gollner | |
| 6,951,102 | B2 | 10/2005 | Tabor | |
| 7,007,466 | B2 | 3/2006 | Price | |
| 7,210,292 | B2 | 5/2007 | Price et al. | |
| 7,213,502 | B2 | 5/2007 | Vonderwell | |
| 7,275,370 | B2 | 10/2007 | Hesse et al. | |
| 7,434,393 | B2 | 10/2008 | Hesse | |
| 7,870,728 | B2 * | 1/2011 | Keuper et al. | 60/422 |
| 2002/0087244 | A1 | 7/2002 | Dix et al. | |
| 2003/0200747 | A1 | 10/2003 | Matsumoto et al. | |
| 2006/0090460 | A1 | 5/2006 | Ma et al. | |
| 2006/0218912 | A1 | 10/2006 | Price et al. | |
| 2006/0230753 | A1 | 10/2006 | Hesse et al. | |
| 2007/0006580 | A1 | 1/2007 | Hesse | |
| 2007/0101709 | A1 | 5/2007 | Cronin | |

FOREIGN PATENT DOCUMENTS

| | | |
|---|---|---|
| WO | 9964761 | 12/1999 |
| WO | 2009005425 A1 | 1/2009 |
| WO | 2009005426 A1 | 1/2009 |

OTHER PUBLICATIONS

Milan Djurovic Und Siegfried Helduser, Elektrohydraulisches Load-Sensing, XP-001212514, Oct. 2004.

* cited by examiner

HYDRAULIC SYSTEM HAVING MULTIPLE ACTUATORS AND AN ASSOCIATED CONTROL METHOD

CROSS REFERENCE TO RELATED APPLICATIONS

The present application claims the benefit of the filing date of U.S. Provisional Patent Application Ser. No. 61/035,183, filed Mar. 10, 2008, the disclosure of which is incorporated herein by reference.

TECHNICAL FIELD

The present invention relates to a hydraulic system having multiple actuators and to an associated control method.

BACKGROUND OF THE INVENTION

Many hydraulic systems include multiple actuators. The actuators are powered by hydraulic fluid supplied from a hydraulic fluid source, such as a pump. As used throughout this description, the words "power" in its various forms when referring to the actuators means to act on the actuators so as to cause movement or actuation, or attempt to cause movement or actuation. One or more valves associated with each actuator control the flow of fluid to and from the actuator. Often, such as in mobile equipment, the multiple actuators are powered simultaneously for performing various functions. For example, in an excavator, an operator may simultaneously power actuators associated with the swing, the arm, and the boom. The loads acting on each actuator differ dependent upon many variables. The pressure for powering the actuators differs dependent upon the load. To power multiple actuators simultaneously, when the actuators are subjected to different loads, it is desirable for the pump to provide sufficient flow and pressure to allow control of all of the actuators. Generally speaking, the valve (or valves) associated with each actuator is controlled to vary the resistance to flow. In the simplest circuits, this allows the valve to control the direction and speed of its associated actuator. In more complex circuit with multiple valve and actuator pairings, the valves commonly are controlled to prevent any one pairing to offer too little resistance, which would result in a reduction in supply pressure below that needed to power the other actuators.

At times, the pump is incapable of maintaining the system pressure at a level for powering all of the actuators at the speeds commanded by the operator. When this occurs, it is desirable to maintain the commanded speed relationships among the various actuators. For example, if the operator of an excavator desires the arm to move at a rate twice that of the boom, it is desirable for this relationship to be maintained even when the pump is incapable of maintaining the pressure for powering the arm and the boom actuators at the speeds commanded by the operator.

SUMMARY

At least one embodiment of the invention provides a hydraulic system comprising an operator input device, a source of hydraulic fluid flow, a plurality of actuators, and a plurality of valves. At least one valve is associated with each actuator for controlling a flow of fluid to and from the actuator. The system further comprises a controller. The controller, in response to a signal from the operator input device, calculates a hydraulic pressure to be supplied to each of the actuators, controls the source of hydraulic fluid flow and the valves for powering the actuators with the calculated hydraulic pressure, monitors a sensed parameter to determine whether the actuators can be powered with the calculated hydraulic pressure, and in response to a determination that the actuators cannot be powered with the calculated hydraulic pressure, calculates a discrepancy ratio and modifies actuation of the actuators with the discrepancy ratio.

According to the invention, the valves are controlled so that sufficient resistance is maintained in the hydraulic system to power the actuators either at their commanded speeds or at reduced speeds while maintaining a relationship of the commanded speeds.

According to various embodiments, the hydraulic system includes a load monitoring sensors for determining a load on each of the actuators. The controller also is responsive to load signals from the load monitoring sensors for calculating the hydraulic pressure to be supplied to each of the actuators.

The valves of the hydraulic system may include one proportional valve associated with each actuator. In another embodiment, the valves include four valves associated with each actuator, two of which are metering-in valves and two of which are metering-out valves.

According to one embodiment, the metering-in valves may include pressure compensating valves. Compensator position indicators may be associated with each of the pressure compensating valves for providing signals indicative of pressure drop across the valves.

Another embodiment of the invention provides a method of controlling a hydraulic system having an operator input device, a source of hydraulic fluid flow, a plurality of actuators, a plurality of valves, and a controller. At least one valve is associated with each actuator for controlling a flow of fluid to and from the actuator. The method comprises the steps of calculating, in response to a signal from the operator input device, a hydraulic pressure to be supplied to each of the actuators; controlling the source of hydraulic fluid flow and the valves for powering the actuators with the calculated hydraulic pressure; monitoring a sensed parameter to determine if the actuators can be powered with the calculated hydraulic pressure; calculating, in response to a determination that the actuators cannot be powered with the calculated hydraulic pressure, a discrepancy ratio; and modifying actuation of the actuators with the discrepancy ratio.

BRIEF DESCRIPTION OF THE DRAWINGS

Embodiments of this invention will now be described in further detail with reference to the accompanying drawings, in which.

DETAILED DESCRIPTION

Figure 1:
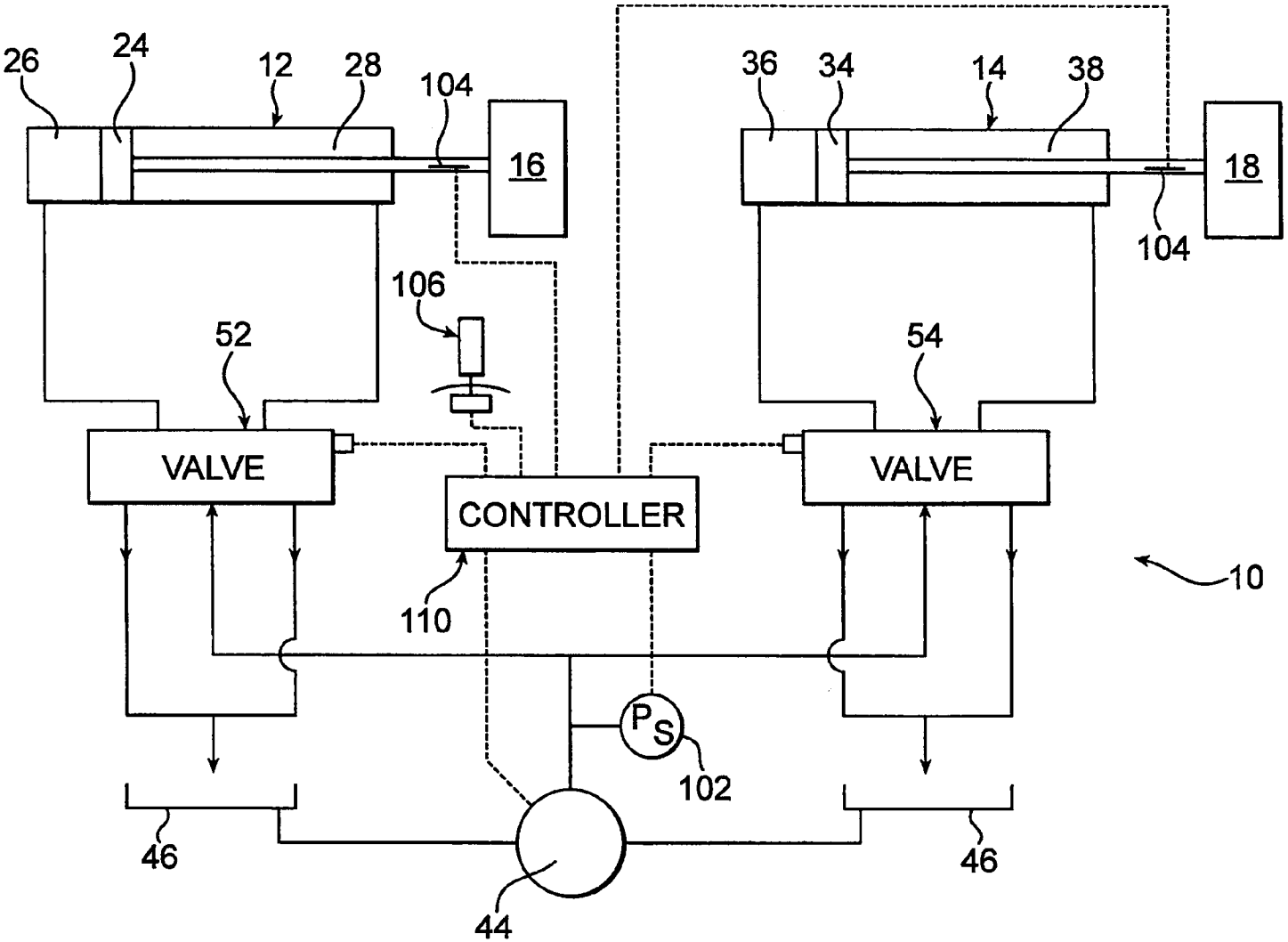
FIG. 1 is a schematic illustration of an exemplary hydraulic system constructed in accordance with the invention.

FIG. 1 schematically illustrates an exemplary hydraulic system 10 constructed in accordance with the invention. The hydraulic system 10 of FIG. 1 includes two actuators 12 and 14, each having an associated function. It should be recognized that the hydraulic system 10 may have more than two actuators, however, for ease of description a system with only two actuators will be described. FIG. 1 schematically illustrates the function associated with the actuator 12 at reference numeral 16 and schematically illustrates the function associated with the actuator 14 at reference numeral 18. The functions 16 and 18 may be any known type of function having an associated actuator. Although illustrated as linear actuators in FIG. 1, the actuators may include any known type of actuator, such as, for example, a rotary actuator.

Actuator 12 includes a movable piston 24 that defines a boundary between a head side chamber 26 and a rod side chamber 28 of the actuator. The piston 24 is movable in response to a pressure differential for changing the volume of the head side and rod side chambers 26 and 28. Movement of the piston 24 results in actuation of the actuator 12. Likewise, actuator 14 includes a movable piston 34 that defines a boundary between a head side chamber 36 and a rod side chamber 38 of the actuator. The piston 34 is movable in response to a pressure differential for changing the volume of the head side and rod side chambers 36 and 38. Movement of the piston 34 results in actuation of the actuator 14.

The hydraulic system 10 also includes a source of hydraulic fluid flow, shown in FIG. 1 as a fixed displacement pump 44. The pump 44 is a pressure controlled pump. Alternatively, a variable displacement pump or a combination of multiple pumps may be used as long as the pump is pressure controlled. The pump 44 is in fluid communication with a reservoir or tank 46 and is adapted to provide fluid to the actuators 12 and 14. The fixed displacement pump 44 of FIG. 1 is preselected to provide fluid up to a predetermined maximum pressure.

The hydraulic system 10 of FIG. 1 also includes two valves 52 and 54. Valve 52 is associated with actuator 12 and controls the flow of fluid from the pump 44 to actuator 12 and from actuator 12 to tank 46. Similarly, valve 54 is associated with actuator 14 and controls the flow of fluid from the pump 44 to actuator 14 and from actuator 14 to tank 46.

Figure 2:
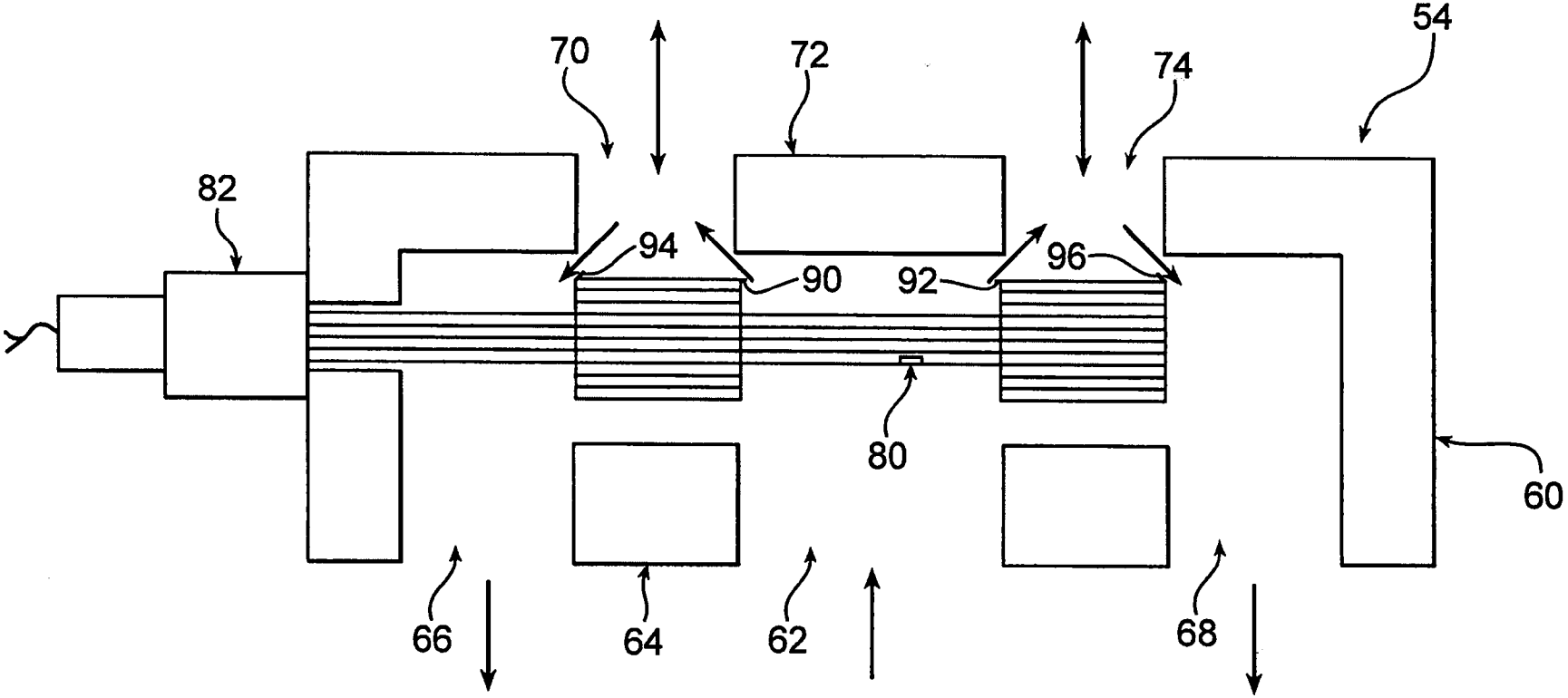
FIG. 2 illustrates an exemplary embodiment of valve.

FIG. 2 illustrates an exemplary embodiment of valve 54. Valve 52 may be constructed similarly. Valve 54 includes a valve body 60 having a plurality of fluid openings. A center opening 62 on a first side 64 of the valve 54 receives fluid from the pump 44. Outer openings 66 and 68 on the first side 64 of the valve body 60 are connected to tank 46. A first opening 70 on a second side 72 of the valve body 60 is connected to the head side chamber 36 of actuator 14 while a second opening 74 is connected to a rod side chamber 38 of actuator 14.

An axially movable spool 80 is located within the valve body 60 and is movable relative to the valve body for controlling the flow of fluid through the valve 54. In the valve 54 illustrated in FIG. 2, an electric solenoid 82 is connected to the valve 54 for moving the spool 80. Alternatively, a stepper motor, a hydraulic actuator, or any other known actuation device may be used for moving the spool 80.

Valve 54 is designed and chosen for its pressure and flow metering characteristics. The spool 80 in the valve 54 illustrated in FIG. 2 has four metering lands 90, 92, 94, and 96 that together with the valve body 60 form orifices through which fluid may flow. Depending upon the location of the spool 80 relative to the valve body 60, fluid may flow through orifices 90 and 92 when flowing from the pump 44 to the actuator 14 and, fluid may flow through orifices 94 and 96 when flowing from the actuator 14 to the tank 46. The orifice sizes vary as the spool 80 is shifted axially relative to the valve body 60.

FIG. 2 illustrates the valve 54 in a neutral position. When the spool 80 is shifted away from the neutral position in one direction, two orifices are opened and two orifices are closed (only leakage flow passes through the closed orifices). For example, if the spool is shifted in rightward, as viewed in FIG. 2, orifices formed by lands 92 and 94 are opened. In response to the orifices formed by lands 92 and 94 opening, hydraulic fluid from the pump 44 is directed into the rod side chamber 38 of the actuator 14 to increase fluid pressure in the rod side chamber of the actuator. In response to the increased pressure in the rod side chamber 38, piston 34 of actuator 14 moves leftward, as viewed in FIG. 1, to increase the volume of the rod side chamber 38 and decrease the volume of the head side chamber 36. Fluid forced out of the head side chamber 36 of the actuator 14 is directed to tank 46. In a similar manner, the leftward movement of the spool of FIG. 2 to open the orifices formed by lands 90 and 96 results in fluid from the pump 44 being directed into the head side chamber 36 of the actuator 14 and out of the rod side chamber 38 of the actuator, resulting in rightward movement of the piston 34, as viewed in FIG. 1.

With reference again to FIG. 1, the hydraulic system 10 also includes a pressure sensor 102 and actuator load sensors 104. The pressure sensor 102 is located between the pump 44 and the valves 52 and 54. In FIG. 1, the pressure sensor 102 is located immediately downstream of the pump 44. The pressure sensor 102 monitors pressure and outputs a signal indicative of the sensed pressure. At least one of the load sensors 104 is associated with each actuator 12 and 14. In FIG. 1, the load sensors 104 are load cells, however, other types of load sensors may be used including, for example, pressure sensors for sensing pressure in the chambers of the actuators so that a load may be determined from the resulting signals. Each load sensor 104 monitors the load applied to the associated actuator and outputs a signal indicative of the sensed load.

The hydraulic system 10 also includes an operator input device 106, illustrated as a joystick in FIG. 1. The operator input device 106 outputs command signals in response to inputs by the operator. The operator's inputs are indicative of commanded actuation of the actuators 12 and 14. Therefore, the command signals from the operator input device 106 are indicative of the operator's commanded movement and speed of the actuators 12 and 14.

The hydraulic system 10 of FIG. 1 also includes a controller 110. The controller 110 may be any type of known controller, such as a microprocessor, an application specific integrated circuit, or a combination of various control devices. The controller 110 receives signals from the pressure sensor 102, the actuator load sensors 104 and the operator input device 106 and, in response to the signals, outputs control signals to the pump 44 and the valves 52 and 54. When the pump 44 is a fixed displacement pump as shown in FIG. 1, the output signal to the pump 44 is merely a signal to turn the pump on or off. When the pump 44 is a variable displacement pump, the output signal from the controller 110 may be used for controlling the displacement. The output signals provided to the valves 52 and 54 from the controller 110 control the actuation of the valves, i.e., the movement of the spool of each valve so as to control the flow of fluid into and out of the associated actuator. The controller 110 attempts to control the pump 44 and the valves 52 and 54 to provide the operator commanded movement and speed of the actuators 12 and 14.

Each actuator 12 and 14 of the hydraulic system 10 is subjected to a particular load and, in response to an input from the operator, is commanded to move in a particular direction and at a particular speed. Each actuator 12 and 14 has a pressure demand for moving as commanded. When the pump 44 is capable of meeting the pressure demand of all of the commanded actuators, the actuators may be powered at the speeds commanded by the operator. When the pump is incapable of meeting the pressure demand of all of the commanded actuators, the commanded speeds of all of the actuators cannot be achieved. When the commanded speeds of all of the actuators cannot be achieved, the controller 110 modifies the commanded speeds of all of the actuators so as to maintain the relationship commanded by the operator.

Figure 3:
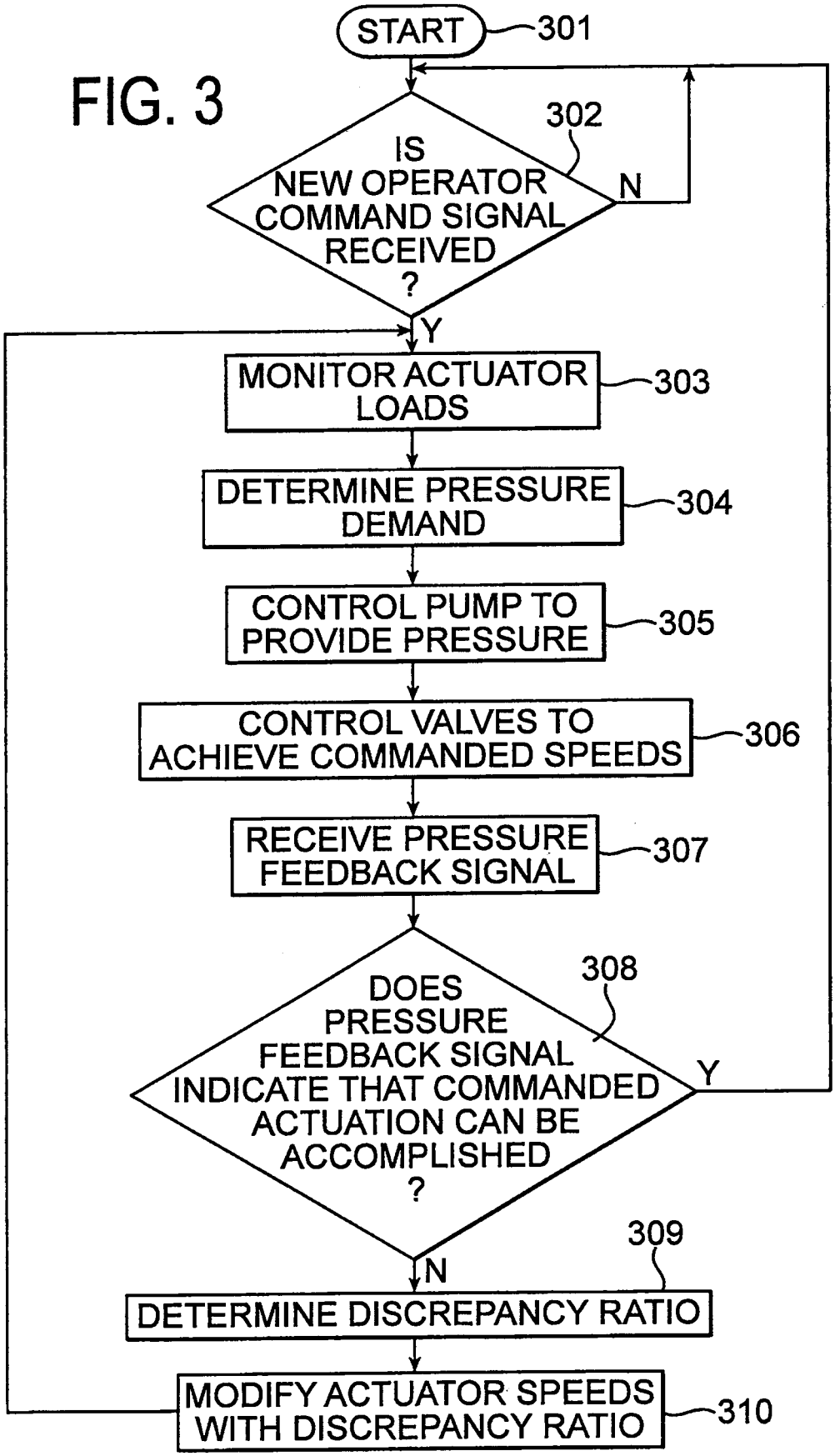
FIG. 3 illustrates a control method of the invention.

FIG. 3 illustrates an exemplary control method of the invention and will be described with reference to the hydraulic system 10 of FIG. 1. With reference to FIG. 3, the method begins at step 301 in which the machine having the hydraulic system 10 is turned on and power is provided to the hydraulic system. At step 302, the controller 110 determines whether any new operator command signals were received from the operator input device 106. If no new command signals were received from the operator input device 106, the determination of step 302 is repeated at the next cycle time for the controller 110. If a new operator command signal was received by the controller 110, the method continues to step 303 in which the controller 110 monitors the signals provided by actuator load sensors 104. At step 304, the controller 110 determines the pressure demand for moving the actuators 12 and 14 at the operator commanded speeds.

The pressure demand for moving the actuators 12 and 14 at the operator commanded speeds may be determined in a number of ways. For example, the controller 110 may include a memory with a lookup table that correlates various loads and command signals to corresponding pressure demands. Alternatively, the pressure demand may be calculated. For example, the pressure demand for moving all of the actuators at their commanded speed may be summarized by the following equation:

$$\text{Pump Pressure}=P_S=f(v_{com},\text{valve size})+f(\text{Load})+f(H_{LL})+f(\alpha)$$

where, $v_{Com}$, is the commanded speed, $H_{LL}$ is the hydraulic line losses, and $\alpha$ is acceleration. Ignoring the acceleration term, i.e. considering the steady state case and ignoring the hydraulic line losses ($H_{LL}$), an equation that expresses the pressure demand in terms of the commanded speed, valve size and flow coefficient is as follows:

$$P_S = \frac{v^2 A_{PE}^2}{K_{VPL}^2}\left[1+\frac{\rho_v^2}{\rho_c^3}\right]+\frac{F_L}{A_{PE}}$$

where, $F_L$ is the force of the load, $A_{PE}$ is the area of the powered end of the piston, v is the actuator velocity, $K_{VPL}$ is the valve coefficient, $\rho_v$ is the valve ratio, and $\rho_c$ is the area ratio of the actuator (cylinder). The controller 110 performs this calculation for each actuator 12 and 14 and the highest calculated pressure is the pressure demand of the hydraulic system 10.

From step 304, the method proceeds to step 305 in which the controller 110 controls the pump 44 to provide pressure. If the pump 44 is a fixed displacement pump, this step is satisfied by the pump 44 being powered to provide fluid at its fixed displacement. If the pump 44 is a variable displacement pump, the controller 110 satisfies this step by controlling the displacement of the pump 44 to provide and maintain the demanded pressure.

At step 306, the controller 110 controls the valves 52 and 54 to achieve the commanded speeds for the associated actuators 12 and 14. For example, the controller 110 outputs control signals to the solenoids of the valves 52 and 54 to be actuated for moving the spools to provide appropriate amounts of fluid to the associated chamber of the actuator 12 or 14 for powering the actuator at the demanded speed. To perform this step, the controller 110 controls the valves 52 and 54 so that enough flow is provided to the actuators 12 and 14 to power each actuator at the commanded speed. The controller 110 determines the pressure either through calculations similar those described above or by referencing a lookup table.

At step 307, the controller 110 receives a pressure feedback signal. In the hydraulic system 10 of FIG. 1, the pressure feedback signal is the signal from the pressure sensor 102. At step 308, the controller 110 determines whether the pressure feedback signal indicates that the commanded actuation can be achieved. To perform this step, the controller 110 of FIG. 1 determines whether the actual pressure monitored by the pressure signal 102 equals or exceeds the demanded pressure. If the determination at step 308 is affirmative and the actual pressure equals or exceeds the demanded pressure, the commanded speeds of the actuators 12 and 14 can be achieved. In response to an affirmative determination at step 308, the method returns to step 302. If the determination at step 308 is negative and the actual pressure is less than the demanded pressure, then the commanded speeds of the actuators 12 and 14 cannot be achieved and the method proceeds to step 309.

At step 309, the controller 110 determines a discrepancy ratio. The discrepancy ratio is determined by dividing a function of the actual pressure by a function of the demanded pressure. In its simplest form, the discrepancy ratio may be determined by dividing the actual pressure as sensed by the pressure sensor 102 (in bars) by the demanded pressure. Other functions may include, for example, dividing the square root of the actual pressure by the square root of the demanded pressure. The discrepancy ratio is a value between 0 and 1. For example, if the sensed pressure is 7 bars and the demanded pressure is 10 bars, the discrepancy ratio is 7 divided by 10, or 0.7. At step 310, the speeds of actuation for the actuators 12 and 14 are modified with the discrepancy ratio. To modify the actuator speeds, each of the commanded speeds is multiplied by the discrepancy ratio. By multiplying each commanded speed by the discrepancy ratio, the relationship of the commanded speeds is maintained. From step 310, the process returns to step 304.

Figure 4:
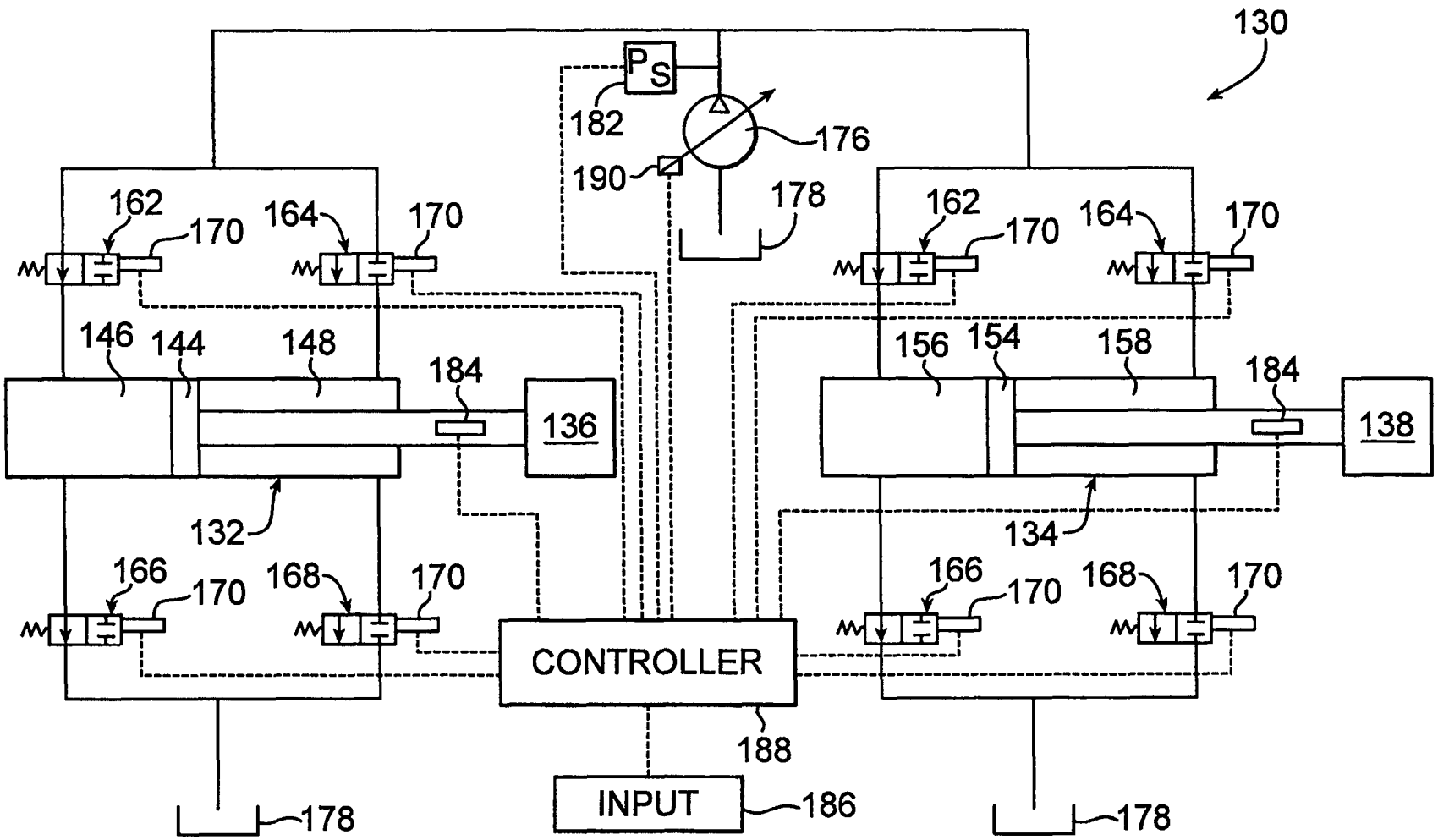
FIG. 4 illustrates a hydraulic system constructed in accordance with another embodiment of the invention.

FIG. 4 illustrates a hydraulic system 130 constructed in accordance with a second embodiment of the invention. The hydraulic system 130 of FIG. 4 includes two actuators 132 and 134, each having an associated function 136 and 138, respectively. Actuator 132 includes a movable piston 144 that defines a boundary between a head side chamber 146 and a rod side chamber 148 of the actuator. Similarly, actuator 134 includes a movable piston 154 that defines a boundary between a head side chamber 156 and a rod side chamber 158 of the actuator.

The hydraulic system 130 of FIG. 4 includes eight valves; four of which are associated with each actuator 132 and 134. The four valves for each actuator include two metering-in valves 162 and 164 and two metering-out valves 166 and 168. In some instances, valves 162 and 164 may meter flow out of the actuator and valves 166 and 168 may meter flow into the actuator, however, for ease of description, the valves 162 and 164 on the supply side of the actuator will be referred to as "metering-in valves" and the valves on the return side of the actuator will be referred to as "metering-out valves." The two metering-in valves include one valve 162 for controlling the flow of fluid into the head side chamber of each actuator and one valve 164 for controlling the flow of fluid into the rod side chamber of each actuator. The two metering-out valves include one valve 166 for controlling the flow of fluid out of the head side chamber of each actuator and one valve 168 for controlling the flow of fluid out of the rod side chamber of each actuator. Each valve 162, 164, 166, and 168 of FIG. 4 is an independently controlled proportional valve. An actuator 170, such as a solenoid actuator, of each valve is actuatable for controlling the flow of fluid through the valve.

The four valves 162, 164, 166 and 168 associated with each actuator 132 and 134 control the flow of fluid from a pump 176 to the actuator and from the actuator to tank 178. For example, to extend actuator 132, valves 162 and 168 are opened. Valve 162 is opened to enable the flow of fluid from the pump 176 to the head side chamber 146 of the actuator 132. A pressure differential created by fluid entering the head side chamber 146 of the actuator 132 tends to force the piston 144 of the actuator rightward, as viewed in FIG. 4. The rightward movement of the piston 144 reduces the volume of the rod side chamber 148 of the actuator 132 forcing fluid out of the rod side chamber. The fluid forced out of the rod side chamber 148 of the actuator 132 passes through valve 168 and is directed to tank 178. Similarly, to retract actuator 132, valves 164 and 166 are opened. As a result, fluid from the pump 176 is directed through valve 164 to the rod side chamber 148 of the actuator 132 to move the piston 144 leftward, as viewed in FIG. 4, and fluid is directed out of the head side chamber 146 of the actuator 132 through valve 166 to tank 178.

The hydraulic system 130 of FIG. 4 also includes a pump 176, a pressure sensor 182, actuator load sensors 184 (at least one of which is associated with each actuator 132 and 134), an operator input device 186, and a controller 188. The pump 176 illustrated in FIG. 4 is a variable displacement pump. The pump 176 includes a device 190 for varying displacement, such as a moveable swash plate. The pressure sensor 182, actuator load sensors 184, and operator input device 186 are similar to those described above with reference to FIG. 1. The controller 188 receives signals from the pressure sensor 182, actuator load sensors 184, and the operator input device 186 and is responsive to the signals for providing control signals to the pump 176 and the valves 162, 164, 166, and 168. The control signal to the pump 176 controls the displacement of the pump for providing and maintaining a pressure to the metering-in valves 162 and 164. The control signals provided to the valves 162, 164, 166, and 168 controls the flow of fluid through the valves and into and out of the actuators 132 and 134. The controller 188 attempts to control the pump 176 and the valves 162, 164, 166, and 168 to provide the operator commanded movement and speed of the actuators 132 and 134.

Each actuator 132 and 134 of the hydraulic system 130 is subjected to a particular load and, in response to an input from the operator, is commanded to move in a particular direction and at a particular speed. Each actuator 132 and 134 has a pressure demand for moving as commanded. When the pump 176 is capable of meeting the pressure demand of all of the commanded actuators, the actuators may be powered at the speeds commanded by the operator. When the pump 176 is incapable of meeting the pressure demand of all of the commanded actuators, the commanded speeds of all of the actuators cannot be achieved. When the commanded speeds of all of the actuators cannot be achieved, the controller 188 modifies the commanded speeds of all of the actuators so as to maintain the relationship commanded by the operator.

The controller 188 of FIG. 4 may follow the control method described earlier with reference to FIG. 3. Since the pump 176 in FIG. 4 is a variable displacement pump, Step 305 of the control method of FIG. 3, when applied to the hydraulic system 130 of FIG. 4, includes controlling the displacement of the pump so as to provide, if possible, the demanded pressure. Since the valves 162, 164, 166, and 168 of the hydraulic system 130 of FIG. 4 are independently controlled, step 306 of the control method of FIG. 3, when applied to the hydraulic system 130 of FIG. 4, consists of merely controlling the flow through the appropriate valves.

Figure 5:
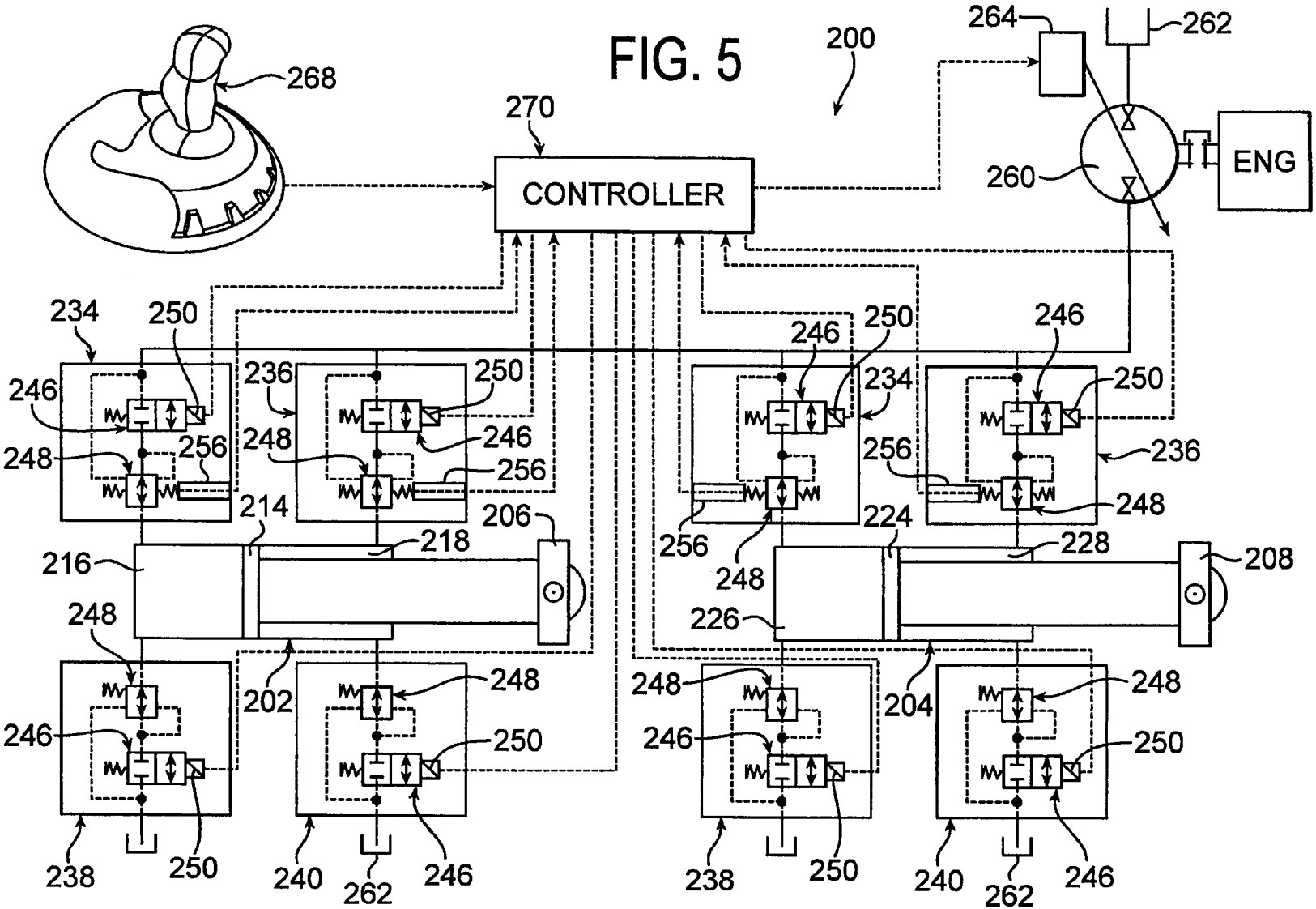
FIG. 5 illustrates a hydraulic system constructed in accordance with yet another embodiment of the invention.

FIG. 5 illustrates a hydraulic system 200 constructed in accordance with yet another embodiment of the invention. The hydraulic system 200 illustrated in FIG. 5 also includes two actuators 202 and 204, each having an associated function 206 and 208, respectively. As with the hydraulic systems 10 and 130 described previously, the hydraulic system 200 of FIG. 5 may include more than two actuators but for ease of description a system having only two actuators will be described. Actuator 202 includes a movable piston 214 that defines a boundary between a head side chamber 216 and a rod side chamber 218 of the actuator. Similarly, actuator 204 includes a movable piston 224 that defines a boundary between a head side chamber 226 and a rod side chamber 228 of the actuator.

The hydraulic system 200 of FIG. 5 also includes eight valves; four of which are associated with each actuator. The four valves associated with each actuator include two metering-in valves 234 and 236 and two metering-out valves 238 and 240. As in the previous embodiment, valves 234 and 236 on the supply side of the actuator will be referred to as "metering-in valves" and, valves 238 and 240 on the return side of the actuator will be referred to as "metering-out valves."

Each valve 234, 236, 238, and 240 of FIG. 5 is a pressure compensating valve. Each pressure compensating valve includes a pilot portion 246 and a pressure compensator portion 248. The pilot portion 246 includes an actuator 250, such as a solenoid, that is controllable for regulating flow through the valve. The compensator portion 248 includes a spool that moves hydromechanically to maintain a predetermined pressure drop across the pilot portion 246. For example, if the predetermined pressure drop across the pilot portion 246 of the valve is 10 bar, the spool of the compensator portion 248 moves so as to attempt to maintain this 10 bar pressure drop across the pilot portion 246. Although the metering-out valves 238 and 240 of FIG. 5 are illustrated as pressure compensating valves, those skilled in the art should recognize that valves having a simpler construction may be used for the metering-out valves.

The hydraulic system 200 of FIG. 5 also includes compensator position indicators 256 that are associated with each metering-in valve 234 and 236. The compensator position indicators 256 sense the position of the spool of the compensator portion 248 of the valve and output a signal indicative of the sensed position.

The hydraulic system of FIG. 5 also includes a pump 260 and a tank 262. The pump 260 illustrated in FIG. 5 is a pressure controlled pump. The pump 260 includes a device 264, such as a moveable swash plate, that is responsive to control signals for varying displacement so that the output pressure of the pump may be controlled.

The hydraulic system 200 also includes an operator input device 268, illustrated as a joystick in FIG. 5. The operator input device 268 is responsive to inputs by the operator to provide command signals indicative of the operator commanded movement and speed of the various actuators 202 and 204.

A controller 270 of the hydraulic system 200 receives input signals from the operator input device 268 and the compensator position indicators 256 and provides control signals to the pump 260 and the actuators 250 of the pilot portions 246 of the valves 234, 236, 238, and 240 for controlling the actuation of the actuators 202 and 204. The control signal provided to the pump 260 controls the pressure setting of the pump, while the control signals provided to the pilot portions 246 of the valves 234, 236, 238 and 240 to be actuated open the pilot portions to enable flow to the associated actuator. The controller 270 attempts to control the pump 260 and valves to provide the operator commanded movement and speed of the actuators 202 and 204.

Each actuator 202 and 204 of the hydraulic system 200 is subjected to a particular load and, in response to an input from the operator, is commanded to move in a particular direction and at a particular speed. Each actuator 202 and 204 has a pressure demand for moving as commanded. When the pump 260 is capable of meeting the pressure demand of all of the commanded actuators, the actuators may be powered at the speeds commanded by the operator. When the pump 260 is incapable of meeting the pressure demand of all of the commanded actuators, the commanded speeds of all of the actuators cannot be achieved. When the commanded speeds of all of the actuators cannot be achieved, the controller 270 modifies the commanded speeds of all of the actuators so as to maintain the relationship commanded by the operator.

As an example, assume that in order to power the actuators as commanded by the operator, the pressure in the head side chamber 216 of actuator 202 should be 70 bar, the pressure in the head side chamber 226 of actuator 204 should be 100 bar, and the pressure provided by the pump 260 is 110 bar. When valve 234 of actuator 202 is capable of providing a 40 bar pressure drop and valve 234 of actuator 204 is capable of providing a 10 bar pressure drop, then the operator commanded speeds of the actuators 202 and 204 may be achieved. If, however, the displacement of the pump is maximized and, for example, valve 234 of actuator 204 can only provide a 7 bar pressure drop, then the commanded speeds of all of the actuators cannot be achieved and, the controller 270 modifies the commanded speeds of the actuators 202 and 204 so as to maintain the relationship commanded by the operator.

Figure 6:
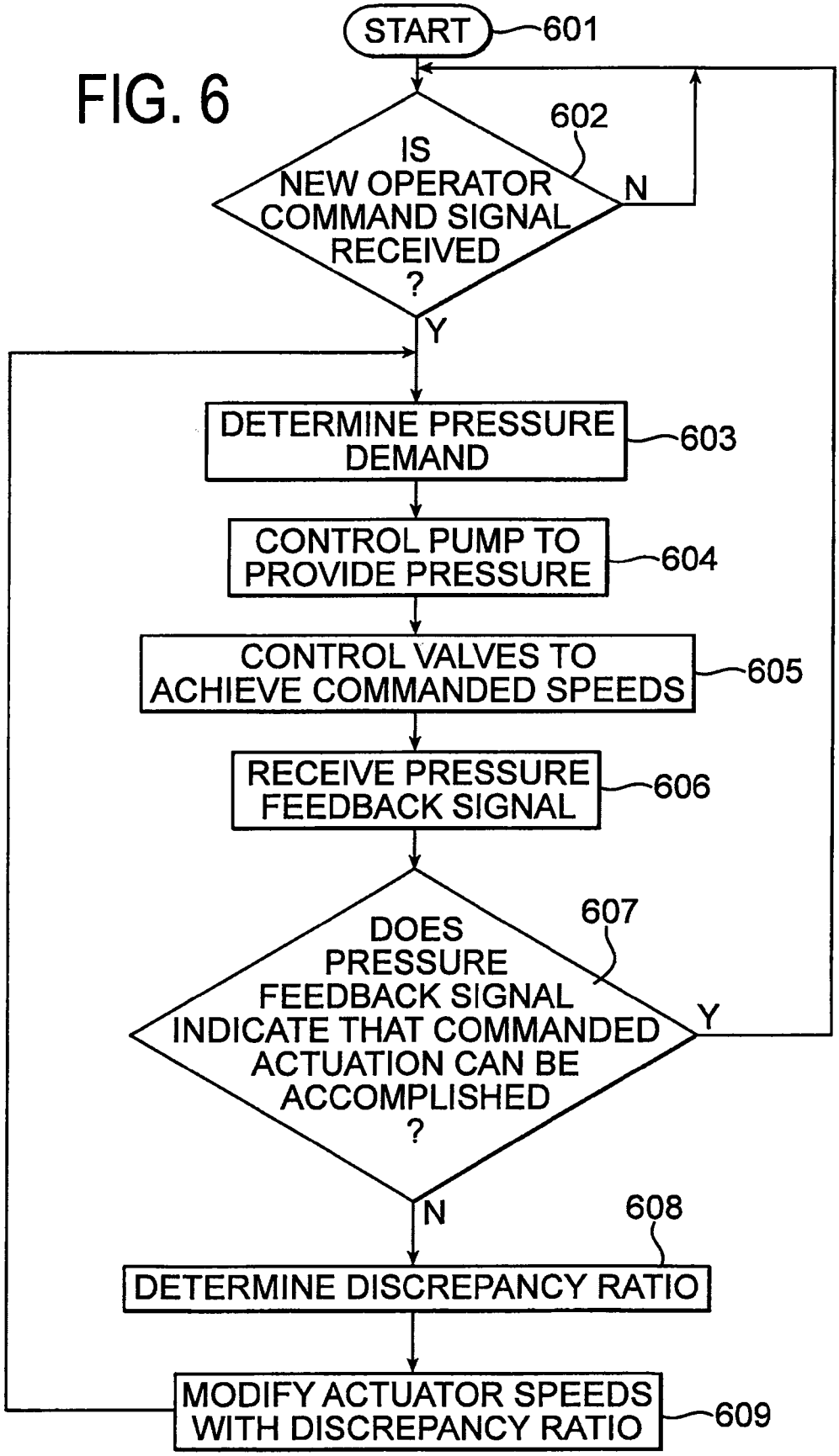
FIG. 6 illustrates another control method of the invention.

FIG. 6 illustrates an exemplary control method of the invention and will be described with reference to the hydraulic system 200 of FIG. 5. It should be noted that the control method of FIG. 6 is similar to that set forth in FIG. 3 with the exception that the method of FIG. 6 does not include the step of monitoring the actuator loads (step 303 in FIG. 3). With reference to FIG. 6, the method begins at step 601 in which the machine having the hydraulic system 200 is turned on and power is provided to the hydraulic system. At step 602, the controller 270 determines whether any new operator command signals were received from the operator input device 268. If no new commands were received from the operator input device 268, the determination of step 602 is repeated at the next cycle time for the controller 270. If a new operator command signal was received by the controller 270, the method continues to step 603 in which the controller 270, in response to signals indicating the current positions of the spools of the compensator portion 248 of the valves, determines the pressure demand for moving the actuators 202 and 204 at the operator commanded speed by, for example, referencing a lookup table stored in memory that correlates various command signals and compensator portion 248 positions to a corresponding pressure demand.

From step 603, the method proceeds to step 604 in which the controller 270 controls the pump 260 to provide the demanded pressure. At step 605, the controller 270 controls the valves 234, 236, 238, and 240 to achieve the commanded speeds for the associated actuators 202 and 204. It should be noted that the spools of the compensator portions 248 of the valves may change positions in response to changes in pressure or changes in flow through their associated pilot portion 246 in order to maintain the desired pressure drop across their associated pilot portions 246. At step 606, the controller 270 receives a pressure feedback signal. In the hydraulic system of FIG. 5, the pressure feedback signal is a signal indicative of the position of the spool of the compensator portion 248 of the valves 234 and 236. Note that this position may differ from the position previously received at the controller 270. At step 607, the controller 270 determines whether the pressure feedback signal indicates that the commanded actuation can be achieved. To perform step 607, the controller 270 of FIG. 5 compares the indicated position of the spool of the compensator portion 248 of each valve 234 and 236 as received from the compensator position indicators 256 to desired positions of the spools of the compensator portion. The controller 270 knows, for example from reference to a lookup table, a desired position of the spool of the compensator portion 248 of each valve for achieving the operator commanded speed for the various actuators at the commanded pressure of the pump. When the indicated position matches the desired position for each valve 234 and 236 of each actuator 202 and 204, the determination at step 607 is affirmative and the commanded speeds of the actuators 202 and 204 can be achieved. In response to an affirmative determination at step 607, the method returns to step 602. If the determination at step 607 is negative and the indicated position of one or more compensator portions 248 does not match the desire position, then the commanded speeds of the actuators 202 and 204 cannot be achieved and the method proceeds to step 608.

At step 608, the controller 270 determines a discrepancy ratio. In the hydraulic system 200 of FIG. 5, the discrepancy ratio is determined by dividing a function of the actual pressure drop across a valve 234 or 236 by a function of the desired pressure drop across the valve. In its simplest form, the discrepancy ratio may be determined by dividing the actual pressure drop across the compensator portion 248 of the valve, as indicated by the position of the spool of the compensator portion 248, by the desired pressure drop across the compensator portion 248 of the valve. The discrepancy ratio is a value between 0 and 1. For example, if the desired pressure drop across the compensator portion 248 is 10 bar and the sensed position of the compensator portion 248 indicates a pressure drop of 7 bar, then the discrepancy ratio is 7 bar divided by 10 bar, or 0.7. In an instance in which the desired pressure drop is not achieved in more than one valve, the controller uses the lowest ratio of the actual pressure drop to the desired pressure drop as the discrepancy ratio.

At step 609, the actuator speeds are modified with the discrepancy ratio. To modify the actuator speeds, each of the commanded speeds is multiplied by the discrepancy ratio. By multiplying each commanded speed by the discrepancy ratio, the relationship of the commanded speeds is maintained. From step 609, the process returns to step 603 and steps are repeated for the modified commanded speeds.

Although the principles, embodiments and operation of the present invention have been described in detail herein, this is not to be construed as being limited to the particular illustrative forms disclosed. They will thus become apparent to those skilled in the art that various modifications of the embodiments herein can be made without departing from the spirit or scope of the invention.

What is claimed is:

1. A hydraulic system comprising:

an operator input device for providing signals that are indicative of operative commands;

a source of hydraulic fluid flow;

a plurality of actuators;

a plurality of valves, at least one valve being associated with each actuator for controlling a flow of fluid to and from the actuator;

a pressure sensor for sensing an actual pressure between the source of hydraulic fluid flow and the valves and for generating in a pressure signal; and a controller that, in response to a signal from the operator input device, calculates a hydraulic pressure to be supplied to each of the actuators to move the actuators as commanded, controls the source of hydraulic fluid flow and the valves for powering the actuators with the calculated hydraulic pressure, thereafter monitors the pressure signal that is generated by the pressure sensor to determine whether the source of hydraulic fluid flow is capable of providing the calculated hydraulic pressure, and in response to a determination that the source of hydraulic fluid flow is not capable of providing the calculated hydraulic pressure, calculates a discrepancy ratio by dividing the pressure signal from the pressure sensor by the hydraulic pressure to be supplied to each of the actuators, and modifies actuation of the actuators with the discrepancy ratio.

2. The hydraulic system of claim 1 wherein the controller modifies the actuation of the actuators with the discrepancy ratio by multiplying a commanded speed of each actuator by the discrepancy ratio to determine a modified actuation speed for the actuator, calculating a modified hydraulic pressure to be supplied to the actuator for powering the actuators at the modified actuation speed, and controlling the source of hydraulic fluid flow and the valves for powering the actuators with the modified hydraulic pressure.

3. The hydraulic system of claim 1 further including a plurality of load monitoring sensors, at least one load monitoring sensor associated with each actuator for determining a load on the actuator and providing a load signal to the controller, the controller using the load signal to calculate the hydraulic pressure to be supplied to the actuator to move the actuator as commanded.

4. The hydraulic system of claim 3 wherein the load monitoring sensors are load cells attached to the rods of the actuators.

5. The hydraulic system of claim 1 wherein only one valve is associated with each actuator, the valve being a proportional valve having a spool that is movable for controlling the flow of fluid to the actuator from the source of hydraulic fluid flow and from the actuator to tank.

6. The hydraulic system of claim 5 wherein the source of hydraulic fluid flow is a fixed displacement hydraulic pump.

7. The hydraulic system of claim 1 wherein four valves are associated with each actuator, the four valves comprising a first metering-in valve for controlling flow into a head side chamber of the actuator, a second metering-in valve for controlling flow into a rod side chamber of the actuator, a first metering-out valve for controlling flow out of the head side chamber of the actuator, and a second metering-out valve for controlling flow out of the rod side chamber of the actuator.

8. The hydraulic system of claim 7 wherein the first and second metering-in valves are proportional valves.

9. The hydraulic system of claim 8 wherein the source of hydraulic fluid flow is a variable displacement hydraulic pump.

10. The hydraulic system of claim 7 wherein the first and second metering-in valves are pressure compensating valves.

11. The hydraulic system of claim 10 wherein each of the pressure compensating valves includes a pilot portion and a compensating portion and being controlled by the controller for establishing a desired pressure drop across the pilot portion of each pressure compensating valve.

12. The hydraulic system of claim 11 wherein the pressure sensor provided by a compensator position indicator associated with each compensating portion of the pressure compensating valves, the compensator position indicator sensing a position of a spool of the compensator portion and outputting a signal indicative of the sensed spool position.

13. A method of controlling a hydraulic system having an operator input device for providing signals indicative of operator commands, a source of hydraulic fluid flow, a plurality of actuators, a plurality of valves, a pressure sensor for sensing an actual pressure between the source of hydraulic fluid flow and the valves and for generating a pressure signal, and a controller, at least one valve being associated with each actuator for controlling a flow of fluid to and from the actuator, the method comprising the steps of:

calculating, in response to a signal from the operator input device, a hydraulic pressure to be supplied to each of the actuators to move the actuators as commanded;

controlling the source of hydraulic fluid flow and the valves for powering the actuators with the calculated hydraulic pressure;

thereafter monitoring the pressure signal that is generated by the pressure sensor to determine whether the source of hydraulic fluid flow is capable of providing the calculated hydraulic pressure;

calculating, in response to a determination that the source of hydraulic fluid flow is not capable of providing the calculated hydraulic pressure, a discrepancy ratio by dividing the pressure signal from the pressure sensor by the hydraulic pressure to be supplied to each of the actuators; and modifying actuation of the actuators with the discrepancy ratio.

14. The method of claim 13 further including the steps of sensing the load acting on each actuator and using the sensed load to calculate the hydraulic pressure to be supplied to the actuator to move the actuator as commanded.

15. The method of claim 13 wherein the step of monitoring a sensed parameter includes the step of sensing an actual pressure between the source of hydraulic fluid flow and the valves, the step of calculating a discrepancy ratio comprising the steps of dividing the sensed actual pressure by the calculated hydraulic pressure to be supplied to each actuator and using a lowest value as the discrepancy ratio.

16. The method of claim 13 wherein the step of modifying actuation of the actuators with the discrepancy ratio includes the step of multiplying a commanded speed of each actuator by the discrepancy ratio to determine modified actuation speeds, calculating a modified hydraulic pressure to be supplied to each of the actuators for powering the actuators with at the modified actuation speeds, and controlling the source of hydraulic fluid flow and the valves for powering the actuators with the modified hydraulic pressure.

* * * * *